US006814646B2

(12) United States Patent
Atobe et al.

(10) Patent No.: US 6,814,646 B2
(45) Date of Patent: Nov. 9, 2004

(54) TOY WITH A WAVERRING OR DANCING FIGURE IN A LIQUID CONTAINER

(75) Inventors: Hirohiko Atobe, Tokyo (JP); Tomohiko Onishi, Tokyo (JP); Mie Ueda, Tokyo (JP); Shigeru Kanauchi, Tokyo (JP)

(73) Assignees: Sega Toys, Ltd., Tokyo (JP); Ing 21 Co., Ltd., Tokyo (JP)

( * ) Notice: Subject to any disclaimer, the term of this patent is extended or adjusted under 35 U.S.C. 154(b) by 0 days.

(21) Appl. No.: 10/712,378

(22) Filed: Nov. 14, 2003

(65) Prior Publication Data

US 2004/0198139 A1 Oct. 7, 2004

(30) Foreign Application Priority Data

Nov. 14, 2002 (JP) ..... 2002-331305
Oct. 8, 2003 (JP) ..... 2003-349336

(51) Int. Cl.[7] ..... A63H 23/08; A63H 3/52

(52) U.S. Cl. ..... 446/267; 446/129; 40/426; 40/409; 40/406

(58) Field of Search ..... 446/267, 129; 40/426, 409, 406

(56) References Cited

U.S. PATENT DOCUMENTS 4,578,044 A 3/1986 Saitoh
5,050,876 A 9/1991 Chuang
5,272,681 A 12/1993 Lee
5,483,764 A * 1/1996 Lin ..... 40/426
6,148,770 A * 11/2000 Lin ..... 40/426

FOREIGN PATENT DOCUMENTS

| | | | | |
|---|---|---|---|---|
| JP | U 59-124909 | | 8/1984 | |
| JP | U 61-39597 | | 3/1986 | |
| JP | 06343768 | A * | 12/1994 | ..... A63H/23/10 |
| JP | 11047451 | A * | 2/1999 | ..... A63H/23/10 |
| JP | 2001327768 | A * | 11/2001 | ..... A63H/23/10 |
| JP | 2001327770 | A * | 11/2001 | ..... A63H/23/10 |
| JP | 2002028381 | A * | 1/2002 | ..... A63H/23/14 |
| RU | SU 1 045 898 | A | 10/1983 | |

* cited by examiner

*Primary Examiner*—Kurt Fernstrom
*Assistant Examiner*—Urszula M Cegielnik
(74) *Attorney, Agent, or Firm*—Oliff & Berridge, PLC

(57) ABSTRACT

A floating toy is provided which can achieve varied and entertaining movements by means of a simple composition. The floating toy comprises: a liquid container section (11, 12) containing liquid therein; a figure (2) of lower specific gravity than the liquid, accommodated inside the liquid container section; magnetic bodies (31, 32) accommodated movably inside the liquid container section; line members (41, 42) extended between the figure and the magnetic bodies; and electromagnetic mechanisms (51, 52) that act on the magnetic bodies. The magnetic bodies and the figure are caused to move against the buoyancy force of the figure, by passing current through the electromagnetic mechanisms, and are caused to return to their original positions by the buoyancy force of the figure, by releasing the passage of current through the electromagnetic mechanisms.

6 Claims, 3 Drawing Sheets

TOY WITH A WAVERRING OR DANCING FIGURE IN A LIQUID CONTAINER

BACKGROUND OF THE INVENTION

1. Field of the Invention

The present invention relates to a toy or an amusing ornament wherein a doll, a model of a fish, or another figure, is caused to move or dance in a clear liquid inside a transparent container, and wherein that movement can be enjoyed.

2. Description of the Related Art

If a figure is caused to move inside a liquid, then the movement thereof will be a comparatively leisurely, wavering movement, compared to movement over the ground or in the air. A toy of this kind is one that can be enjoyed simply by watching the wavering motion.

A toy wherein a figure is caused to move in a liquid is described, for example, in the Japanese Utility Model Application No. S59-124909 (Utility Model Laid-open No. S61-39597). In this toy, a fish-shaped object is disposed floatingly in a container filled with water and tied up through a fine string with a weight having a permanent magnet attached thereto. The weight is rotatably set on the bottom of the container filled with water. A coil, which generates alternating lines of magnetic force, is arranged under the bottom on the outer side of the container. Swimming actions are caused to the fish-shaped object by the alternating magnetic force generated by the coil.

However, the expression of this toy is poor, since it merely causes the weight to rotate in a circle, and it does not provide satisfactory entertainment as a toy.

SUMMARY OF THE INVENTION

It is an object of the present invention to provide a toy which is able to create varied and entertaining movements by means of a simple mechanism.

In order to achieve the aforementioned object, the toy of the present invention comprises: a liquid container section containing a liquid therein; a figure of specific gravity lower than that of the liquid, accommodated inside the liquid container section; a magnetic body accommodated inside the liquid container section and arranged movably in a vertical direction; a line member extended between the figure and the magnetic body; and an electromagnetic mechanism that acts on the magnetic body. Without a magnetic field the magnetic body is pulled up by a buoyant force caused to the figure. Then a descent movement is caused to the figure so as to move against the buoyancy force of the figure by the descent movement of the magnetic body when an electric current is applied through the electromagnetic mechanism. The figure and the magnetic body are caused to return to their original positions by the buoyancy force of the figure, by releasing the passage of current through the electromagnetic mechanism. Thereby, the figure can be caused to make upward and downward movement, and since it returns to its original position by means of the buoyancy force, a natural movement is achieved.

In the toy described above, desirably, a control device for passing a pulse current through the electromagnetic mechanism is provided. Since the movement of the figure is created by a pulse current, power consumption is reduced and varied movement can be achieved by combining pulse currents or changing periods of pulses.

In the toy described above, desirably, plural line members and magnetic bodies may be connected to a plurality of positions on the figure, and the plural magnetic bodies can be arranged so as to move at different timings. By causing the magnetic bodies to move simultaneously, or by causing one only to move, or causing each to move alternately, it can provide a more varied movement.

In the toy described above, desirably, the interval between the line members is greater in the vicinity of the figure than in the vicinity of the magnetic bodies. Thereby, it is possible to cause the figure to move in a horizontal direction, rather than simply the vertical direction, by causing the magnetic body connected to one of the line member to move, or by causing both of the magnetic bodies to move in alternating fashion.

According to the present invention, it is possible to provide a toy which is able to create varied and entertaining movements by means of a simple mechanism and arrangement.

DESCRIPTION OF THE PREFERRED EMBODIMENTS

Below, an embodiment of the present invention is described with reference to the drawings.

(1. Composition of the Toy)

Figure 1:
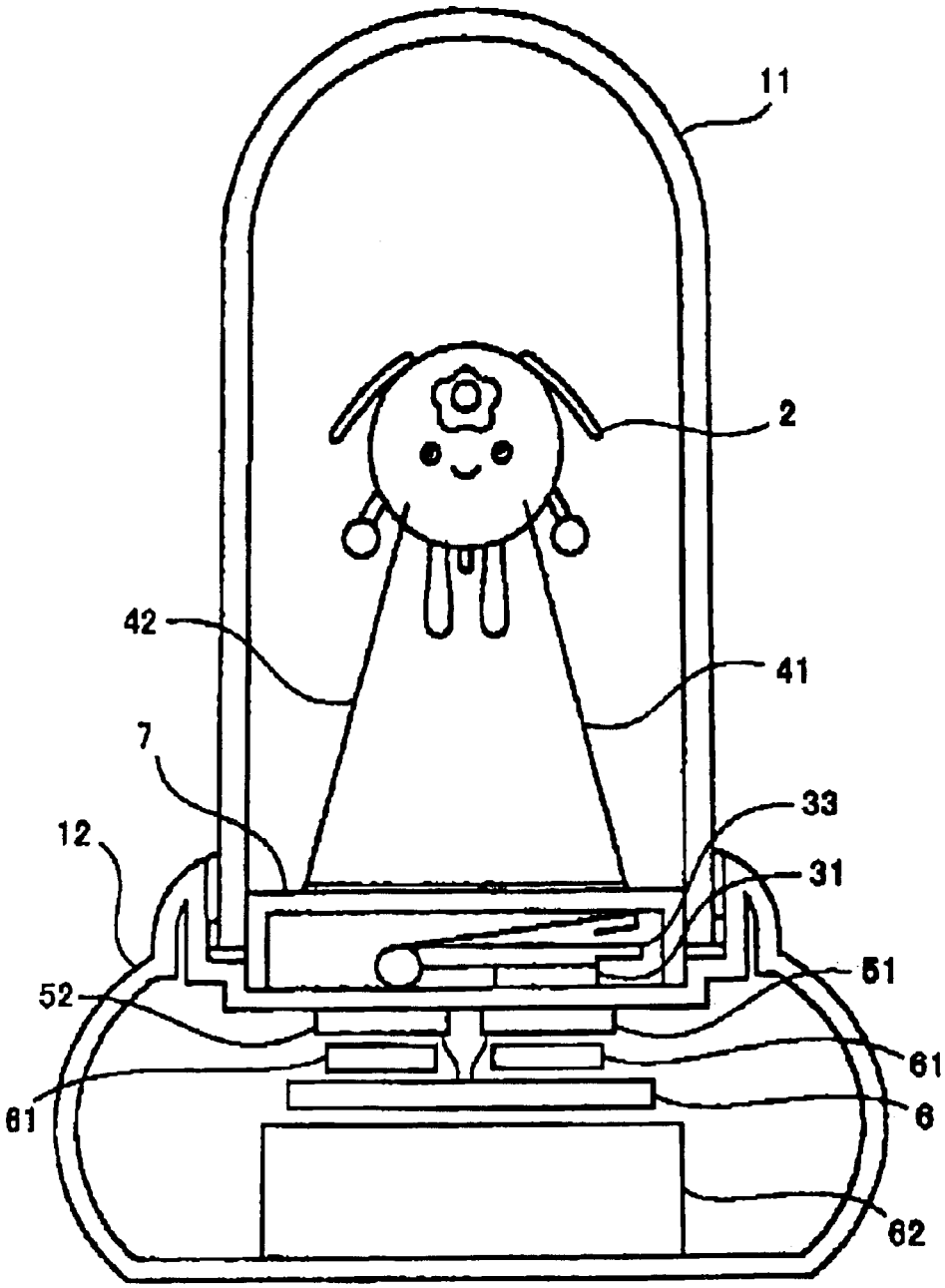
FIG. 1 is a conceptual diagram showing an example of a toy according to an embodiment of the present invention.
Figure 2:
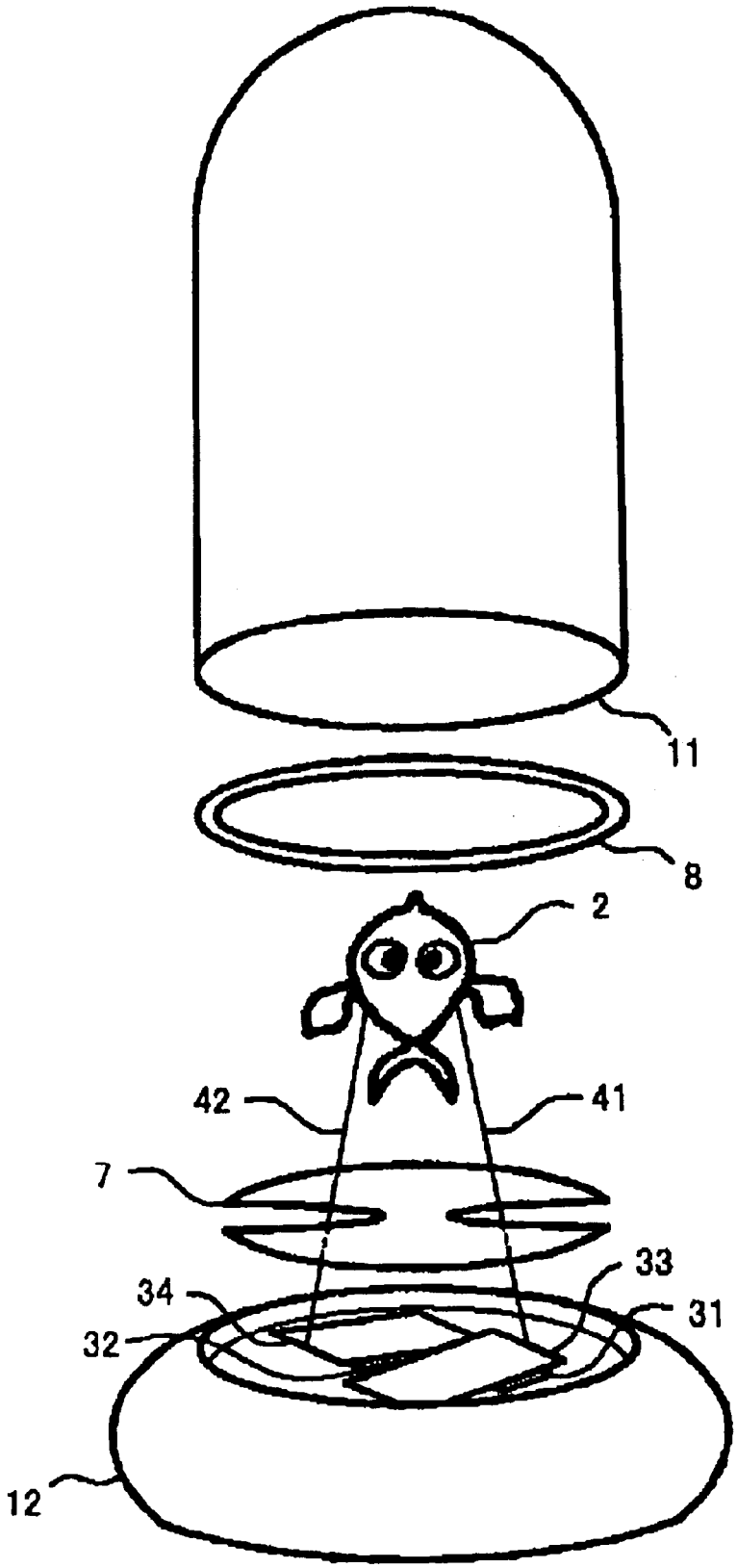
FIG. 2 is a perspective view showing an aspect of the assembly of the toy shown in FIG. 1.

FIG. 1 is a conceptual diagram showing an example of the composition of a toy according to an embodiment of the present invention. FIG. 2 is a perspective diagram showing the aspect of the assembly of this toy. This toy comprises a container main body 11 which accommodates a figure object 2, magnetic members 31, 32, and fine line or string members 41, 42, and comprises a base section 12 which accommodates coils 51, 52 forming electromagnetic mechanisms and a drive unit 6, and the like. The liquid container section according to the present invention is constituted by the container main body 11 and the upper face of the base section 12.

(1-1. Liquid Container Section)

The container main body 11 has a cylindrical shape, one end of which is closed. More specifically, the upper end as illustrated in the diagram is closed in a domed shape, and the lower end as illustrated in the diagram is open. The upper face of the base section 12 is fixed in a watertight fashion, via an O-ring 8 (FIG. 2) to the open end.

The container main body 11 has a transparent section in such a manner that the movement of the figure object 2 contained therein can be seen, and desirably the whole body thereof is transparent. Desirably, the transparent section has colourless transparency or coloured transparency.

The liquid accommodated in the liquid accommodating section is desirably a colourless transparent liquid or a coloured transparent liquid, and desirably, it should be chemically stable and not liable to decomposition, such as water containing a preservative, or ethanol, or the like.

(1-2. Figure Object)

A figure object 2 may be a doll or an object of adorable characters as depicted in FIG. 1 or a body simulating a fish, or dolphin, or other aquatic creature, or a diver, or the like, is accommodated inside the liquid container section. Desirably, the figure object 2 has a lower specific gravity than the liquid contained in the liquid container section, and is made, for example, from foamed styrene or is made of a hollow figure of an ABS (Acrylonitrile Butadiene Styrene) plastic material. The hollow may be filled with foamed styrene. The figure object 2 may be immersed completely in the liquid, or if it is accommodated inside the liquid container section together with a material of lighter specific gravity (air, or the like,) then it may float on the surface of the liquid.

The figure object 2 may be provided with a part simulating a tail, fin, or the like, swingably on a main part or on a central body. Even if it is not driven in particular, a tail or fin of this kind can be caused to flutter from aide to side, by the movement of the main part through the liquid.

(1-3. Magnetic Member)

Swinging plates 33, 34 are provided on the upper face of the base section 12, in other words, at the bottom of the liquid container section. The swinging plates 33, 34 are both flat in shape, and are rotatably supported in the region of one end thereof on the upper face of the base section 12, in such a manner that they can owing upwards and downwards. Magnetic members 31, 32 are fixed respectively to the other ends of the swinging plates 33, 34, in the vicinity of the free nds thereof, in such a manner that they can move upwards and downwards with the swinging motion of the swinging plates 33, 34.

Desirably, the magnetic members 31, 32 are flat in shape, and they may be members which are inherently magnetic (for example, permanent magnets), or they may be members which are not inherently magnetic but which are induced to be magnetic (for example, a magnetic metal such as iron, or the like).

The magnetic members 31, 32 and the swinging platen 33, 34 may themselves have a specific gravity that is greater than that of the contained liquid. In this case, when no current is passed through the coils 51, 52, the magnetic members 31, 32 and the swinging plates 33, 34 can be pulled and raised to a prescribed position, by the buoyancy force caused to the figure object 2.

A blind plate 7 is fixed to the base section 12 above the magnetic members 31, 32 and the swinging platen 33, 34. The purpose of the blind plate 7 is to hide the magnetic members 31, 32 and the swinging plates 33, 34, from external view, but desirably, it is provided with gaps or holes in order to pass the line members 41, 42. Alternatively, the blind plate 7 itself may be made of a plate-shaped net.

Although the swinging plates 33, 34 are able to swing upwards and downwards, the downward movement thereof is restricted by the upper face of the base section 12, and the upward movement thereof is restricted by the blind plate 7. The method for limiting the range of swing of the swinging plates 33, 34 is not limited to this, and it is also possible to provide stoppers on the aforementioned support sections for the base section 12 of the swinging plates.

(1-4. Fine Line Members)

The figure object 2 is linked to the magnetic member 31, 32 by means of respective threads 41, 42 forming line members. More specifically, it is linked respectively to the aforementioned other end or the movable end of the swinging plate 33 on which the magnetic member 31 is fixed, and the aforementioned other end of the swinging plate 34 on which the magnetic member 32 is fixed. The threads 41, 42 are connected to different positions on the figure object 2. In particular, if it is possible to define the right-hand side and left-hand side, or the front and back, of the figure object 2 (for example, if the object is simulating a fish, or the like), then the threads 41, 42 are fixed to approximately symmetrical positions on the right and left-hand sides of the figure object 2.

The interval between the threads 41, 42 is greater in the vicinity of the magnetic members 31, 32 than in the vicinity of the figure object 2.

Desirably, the threads 41, 42 are made of a material that does not visually stand out in the liquid, such as a transparent material, thin material, or the like, but the material should not be limited in particular, and any material, such as fishing line, or the like, may be used. Here, a material of low expandability is used, but an expandable material may also be used.

(1-5. Coils)

Electromagnetic coils 51, 52 are provided on the inner side of the base section 12, in other words, on the outer side of the liquid container section. These coils 51, 52 are able respectively to exercise a magnetic action in the range of movement of the magnetic members 31, 32 in the liquid container section. For this purpose, desirably, the coils 51, 52 are fixed to the walls of the liquid container section, from the outer side. In the present embodiment, they ate fixed to the upper end of the base section 12, from the inner side of the base section. The upper face of the base section 12 is made from a non-magnetic material, in such a manner that it does not shield the magnetic force.

In the present embodiment, the coils 51, 52 are provided on the outer side of the liquid container section in order to avoid problems of liquid leakage or current leakage, but it is also possible to provide them inside the liquid container section, provided that these problems are prevented. Moreover, the invention is not limited to using coils 51, 52, and another magnetic mechanism, such as magnets, with associated moving mechanism which cause the magnets to move for example upwards and downwards so that they engage and disengage with the corresponding magnet members in the liquid container, may also be used.

The coils 51, 52 are connected to a control circuit 6 which controls the current flowing through the coils. The control circuit 6 according to the present embodiment is able to pass a pulse current through the coils 51 and 52, respectively, at any desired timing. In particular, desirably, by means of the control implemented by the control circuit 6, it is possible to pass pulse currents through the coils 51 and 52, at separate timings, and it is also possible to pass pulse currents through the coils 51 and 52, simultaneously. Desirably, a spacer 61 is disposed between the control circuit 6 and the coils 51, 52 and, in order to maintain a uniform distance of separation of the control circuit 6 from the coils, and to shield out electrical and magnetic effects. Desirably, the spacer 61 is made from an insulating material, such as hardened rubber, for example.

The control circuit 6 is connected to a power supply, such as a dry cell battery 62, for example.

In the present embodiment, the number of magnetic members 31, 32, threads 41, 42 and coils 51, 52 provided was respectively two each, but the invention is not limited to this, and for example, three or more of each member may be provided. If three of each member is provided, then the position at which the third thread is fixed to the figure object 2 is desirably displaced towards the front or the rear, with respect to the threads 41 and 42.

(2. Operation of the Toy)

Next, the basic operation of the toy shall be described.

(2-1. When a Pulse Current is Not Supplied)

If no current is supplied to the coils 51 and 52, then neither of the coils 51 and 52 is magnetized and hence there is no action on the magnetic bodies 31, 32. In this case, the figure object 2 is pushed upwards by the buoyancy force, and the magnetic bodies 31, 32 and the swinging plates 33, 34 are pulled and raised to their limit position as determined by the blind plate 7.

(2-2. When Pulse Currents Are Supplied Simultaneously)

When currents of the same magnitude are supplied simultaneously to the coils 51 and 52, then the coils 51 and 52 will be magnetized simultaneously, and the magnetic bodies 31 and 32 will be drawn downwards simultaneously, and with the same degree of force. Thereby, a pulling force is transmitted to the figure object 2 by means of the threads 41 and 42, and hence the figure object 2 is drawn downwards against the buoyancy force.

Here, if the pulse width (the length of the time period for which current is passed) is large enough, then the magnetic bodies 31, 32 and the swinging plates 33, 34 will be able to move until they reach the lower limit position, as determined by the upper face of the base section 12. Consequently, the figure object 2 reaches a bottommost point in its range of movement. When the current is released, the figure object 2 returns to its original position, together with the magnetic bodies 31, 32, due to the buoyancy force.

If the pulse width is small, then a magnetizing force of the coils 51, 52 will attenuate before the magnetic bodies 31, 32 and the swinging plates 33, 34 reach their lower limit position, and the figure object 2 will return to its original position, together with the magnetic bodies 31, 32, due to the buoyancy force, after having been pulled down to an intermediate position.

The size of the pulse width required in order for the magnetic bodies 31, 32 and the swinging plates 33, 34 to reach their lower limit position varies depending on the resistance of the figure object 2 and the swinging plates 33, 34, in the liquid, the buoyancy force of the figure object 2, and the strength of the coils 51, 52, and so on.

If a current having a short pulse width is passed repeatedly, in a consecutive fashion, then the figure object 2 will move reciprocally, up and down, in short and sharp movements. If the resistance of the figure object 2 in the vertical direction with respect to the liquid differs between the region to the front of the installation positions of the threads 41, 42 on the figure object 2 and the region to the rear of these positions, then the region where the resistance is lower will perform greater upward and downward movement. Consequently, for example, if the resistance on the front side is made lower than that on the rear side, by, for instance, making the surface area to the front of the installation positions of the threads 41, 42 a smaller area, then the front side will move upwards and downwards to a greater degree than the rear side, and hence the whole body of the figure object 2 will oscillate in the vertical direction, and the figure object 2 will appear as if it were nodding up and down. If the interval between pulses is short, then the subsequent pulse will arrive before the figure object 2 has returned to its original position due to the buoyancy force, and it will move further downwards, thus appearing as if it were moving downwards in stages.

(2-3. When Pulse Currents Are Supplied at Different Timings)

If a pulse current is supplied to one of the coils 51 and 52 only, then only one of the magnetic bodies will be drawn downwards. Accordingly, only one of the left-hand and right-hand threads attached to the figure object 2 will be pulled, whilst the other one of the threads will not be pulled. Here, since the interval between the threads 41, 42 becomes greater as they proceed in the downward direction, then if, for example, only the right-hand thread is pulled, this will result in the figure object being pulled not only downwards, but also towards the right-hand side. Therefore, the figure object 2 moves in a rightward and downward direction. Moreover, since the threads 41, 42 are installed in symmetrical positions on the right-hand and left-hand sides of the figure object 2, and then if only the right-hand thread is pulled, for example, this will also result in the figure object 2 being inclined towards the right-hand side.

When short pulse currents are supplied alternately to each one of the coils 51 and 52, then the figure object 2 will repeat a motion of: (1) moving down to the right, (2) returning to its original position; (3) moving down to the left; (4) returning to its original position, and so on. If the interval between pulses is made short, then the figure object 2 will repeat a motion of: (1) moving down to the right; (2) pulled to left whilst returning to original position; (3) pulled to right whilst returning to original position; and so on. In either of these cases, the figure object 2 will perform a rightward and leftward movement. Therefore, it is possible to cause the figure object 2 to perform a movement wherein the whole body thereof oscillates towards the right and left, as if it were refusing something.

Moreover, if a plurality of short pulse currents are supplied repeatedly and consecutively to one of the coils 51 and 52, whereby only the right-hand thread is pulled a plurality of times, for example, then the figure object 2 will move upwards and downwards, in a state where it moves towards the right and is inclined towards the right-hand side. If the interval between pulses is short, then the subsequent pulse will arrive before the figure object 2 has returned to its original position due to the buoyancy force, and it will move further downwards, thus appearing as it if were moving downwards in stages, in a state where it moves towards the right and is inclined towards the right-hand side.

(2-4. When the Foregoing Operations Are Combined)

When the operations described above are combined, then it is possible to achieve a rich variety of different movements. Control of the pulse currents of this kind can be achieved by means of a control device 6.

Figure 3:
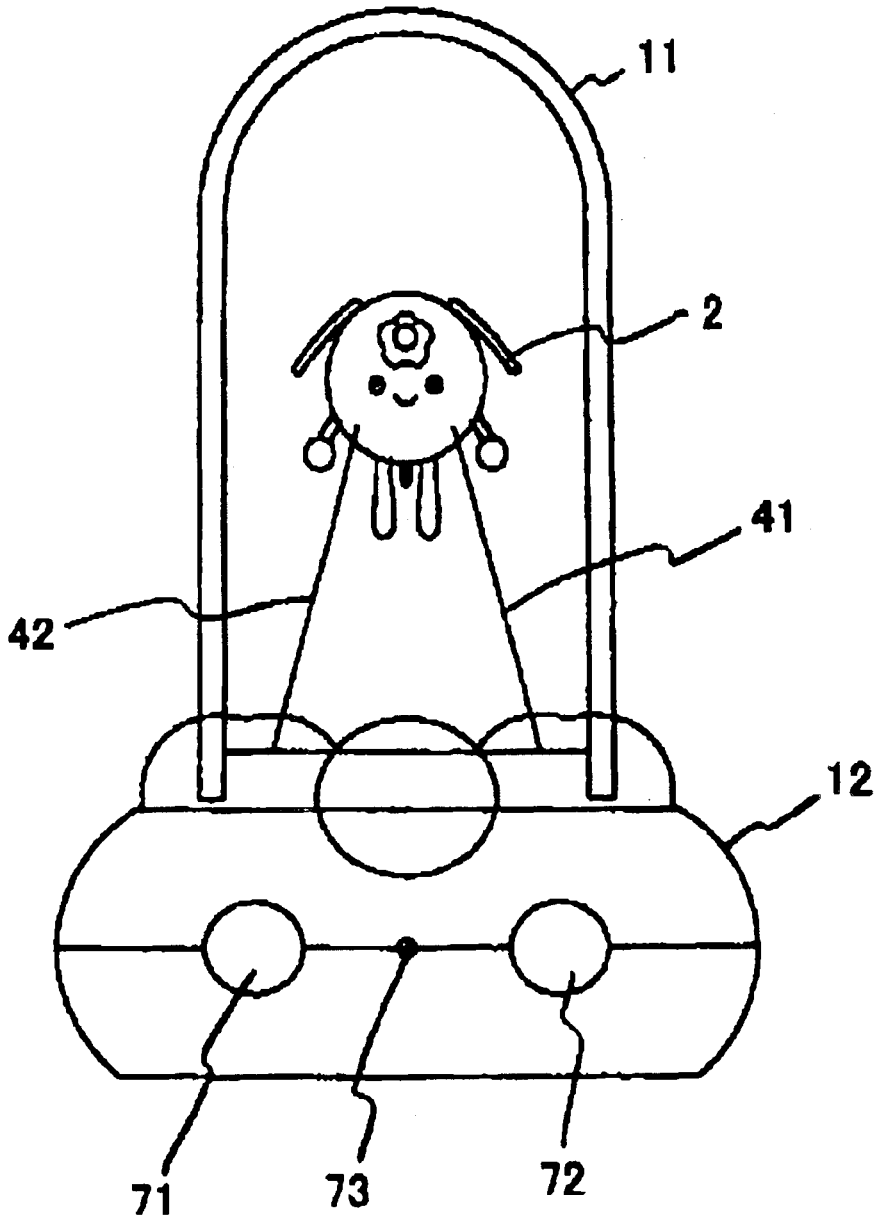
FIG. 3 is a conceptual diagram depicting another variation of a toy according to the present invention.

On the toy explained herein above switches operable by a user or watcher, sensors detecting surrounding sounds and lights or other input devices. One example is shown in FIG. 3. The toy shown in FIG. 3 is provided with a pair of switches 71 and 72 each operable by a user when one of the switches is pressed, the control circuit 6 is triggered starting operation and the figure object 2 starts dancing in accordance with a preset dancing pattern together with a music output from a small speaker 73 installed inside of the base body 12. Another switch may provide another dancing pattern with another music.

The toy in FIG. 3 is further provided with a sound sensor which may detect a voice of a user. When the sensor detects a voice or a certain sound, the control circuit 6 starts generating the pulse current and the figure object 2 starts dancing in accordance with a preset moving pattern and outputs music or may be an imitated voice of the figure object 2 from the speaker 73.

What is claimed is:

1. A toy comprising: a liquid container section containing liquid therein;

a figure object of specific gravity lower than that of said liquid disposed inside said liquid container section so as to be suspended by means of the buoyant force caused by the liquid;

a magnetic body disposed inside said liquid container section so as to move in a vertical direction;

a line member tying said figure object with said magnetic body so as to transmit pulling forces between said figure object and said magnetic body; and an electromagnetic mechanism disposed so as to engage magnetically with said magnetic body when the electromagnetic mechanism is energized;

wherein when said electromagnetic mechanism is energized said magnetic body is caused to move downwardly by means of a magnet force caused between said electromagnetic mechanism and the magnet body and said figure object is caused to move downwardly against the buoyancy force working on said figure object together with the downward movement of the magnet body, wherein the magnet body as well as the figure object are caused to return upwardly to their original positions by the buoyancy force working on said figure object, by releasing said electromagnetic mechanism from the energization.

2. The toy according to claim 1, comprising a control device for energizing the electromagnetic mechanism.

3. The toy according to claim 1, wherein a plurality of magnetic bodies are provided and tied to a plurality of positions on said figure body via separate line members, respectively, and said magnetic bodies are arranged so as to move at different timings.

4. The toy according to claim 3, wherein the interval between said different line members is greater in the vicinity of said magnetic bodies than in the vicinity of said figure object.

5. The toy according to claim 2, wherein the control device starts energizing the electromagnetic mechanism when an input device detects an input.

6. The toy according to claim 2, wherein a plurality of magnetic bodies are provided and tied to a plurality of positions on said figure body via separate line members, respectively, and said magnetic bodies are arranged so as to move at different timings.

* * * * *